United States Patent [19]

Martin

[11] Patent Number: 4,522,585

[45] Date of Patent: Jun. 11, 1985

[54] FIREPLACE STARTER

[76] Inventor: Steven J. Martin, 7221 Clinton Ave. South, Richfield, Minn. 55423

[21] Appl. No.: 609,351

[22] Filed: May 11, 1984

[51] Int. Cl.[3] ..... F23D 13/04

[52] U.S. Cl. ..... 431/344; 431/345; 126/25 B; 239/566

[58] Field of Search ..... 126/25 B; 431/344, 345; 239/566

[56] References Cited

U.S. PATENT DOCUMENTS

| | | | |
|---|---|---|---|
| 65,448 | 6/1867 | Tansey . | |
| 67,382 | 7/1867 | Ausdall . | |
| 420,056 | 1/1890 | Hackney . | |
| 510,447 | 12/1893 | Smith . | |
| 1,012,355 | 12/1911 | Herder . | |
| 1,353,214 | 9/1920 | Calmer . | |
| 1,753,390 | 4/1930 | Taschner . | |
| 3,033,275 | 5/1962 | Nichols . | |
| 3,605,653 | 9/1971 | Donnell | 126/25 B |
| 4,222,734 | 9/1980 | Nolf | 431/156 |
| 4,422,435 | 12/1983 | Spell | 126/25 B |

*Primary Examiner*—Carroll B. Dority, Jr.
*Attorney, Agent, or Firm*—Paul L. Sjoquist

[57] ABSTRACT

Apparatus for igniting a fire in a fireplace or the like, including a canister for compressed combustible gas, a gas release valve, and an elongated hose and a shape-retaining terminal tube, the terminal tube being characterized by having a handle proximate the end thereof connected to the hose, a burn portion equipped with a row of small openings, and a leg portion at each end of the burn portion for supporting the burn portion above a fireplace floor, the distal end of the tube being closed.

7 Claims, 3 Drawing Figures

FIREPLACE STARTER

BACKGROUND OF THE INVENTION

The present invention relates to devices for igniting fires in fireplaces and the like, and more specifically to devices utilizing a combustible gas as the ignition source for such fires.

There is a need for a simple and portable fire starting device, which is particularly adaptable in size and construction for quickly igniting combustible materials placed in a fireplace. Practically all fireplaces found in the home environment utilize metal grates to support wood and the like at an elevated position in the fireplace box, so as to permit the free circulation of combustion air through the burning materials to the chimney at the top of the fireplace box. Such grates are usually constructed of cast iron, and are formed from a number of parallel cast iron ribs supported on legs which stand on the floor of the fireplace box. These grates typically provide 2–3 inches of clearance beneath the fire bed, for accumulating fire ash and the like which is a residue of the fire. When ash accumulations build up to a level proximate the height of the grate they are typically removed to eliminate potential heat damage to the grating material, and also to maintain the proper flow of air circulation for combustion.

At the time a new fire is started it is conventional practice to either clean out the accumulated ash from beneath the grate, or shift the ash pile to the rear of the firebox so as to prepare the firebox for the new fire. It is not unusual to start a new fire by means of building a small paper fire in the space between the grate and the firebox floor. The heat from the paper fire ignites small pieces of kindling wood placed on the grate above the fire. After the kindling wood has become ignited it is the frequent practice to place larger pieces of wood onto the kindling, until a self-sustaining fire has been started amongst the larger pieces of wood. This procedure necessitates a high degree of attention to the starting of a fire, for the fire must be carefully built up from paper, then small and quickly combustible kindling, and finally into the larger logs where a sustaining fire is maintained. Failure to pay proper attention during the building of such a fire results in the flame becoming extinguished, and requires that the procedure be restarted from the beginning.

There is therefore a need for a simple and inexpensive approach to the igniting of fires in fireplaces, preferably one in which special sorting of burning materials into various wood sizes is not required. There is a further need for a fire starting mechanism which may be inserted into the firebox during the starting process, and which may be readily removed after the fire has become started in order to avoid unsightly paraphernalia from remaining in the firebox. This last point is particularly important in present day home fireplaces, which may be both utilitarian in function and aesthetic in design, intended in large part for contributing to the decor in a room setting. In such a setting, unsightly pipes or other paraphernalia permanently installed in a firebox detract from the intended use of the fireplace.

SUMMARY OF THE INVENTION

The preferred embodiment of the invention includes a canister for compressed combustible gas and a valve for permitting selective release of the gas from within the canister. A flexible hose is connected to the valve, and a length of shape-retaining terminal tubing is attached to the hose. The tubing is formed into a first portion of elongated character equipped with a heat insulating handle at its end proximate to the hose connection. The first portion merges into a second portion which is curved to form a leg or foot. A third portion forms a burner length which lies substantially normal or transversely to the first portion and which has a series of openings therein for the escape of combustible gas. And a fourth portion at the terminal end of the tubing is curved to form another leg or foot. The portion equipped with a handle and the two leg or foot portions form a stable supporting tripod for positioning the burn portion at an elevated position. The distal end of the tubing is closed to form a gas tight seal.

Thus the present invention provides a freestanding burner device, namely a device which is but a single length of shape-retaining tubing, for insertion beneath a fireplace grate for the purpose of igniting a fireplace fire.

The composite fireplace igniter is completely portable and self-contained, and may be controlled for providing a greater or lesser igniting flame.

BRIEF DESCRIPTION OF THE DRAWINGS

The foregoing and other advantages of the invention will become apparent from the following which should be read with reference to the appended drawings, in which.

DESCRIPTION OF THE PREFERRED EMBODIMENT

Figure 1:
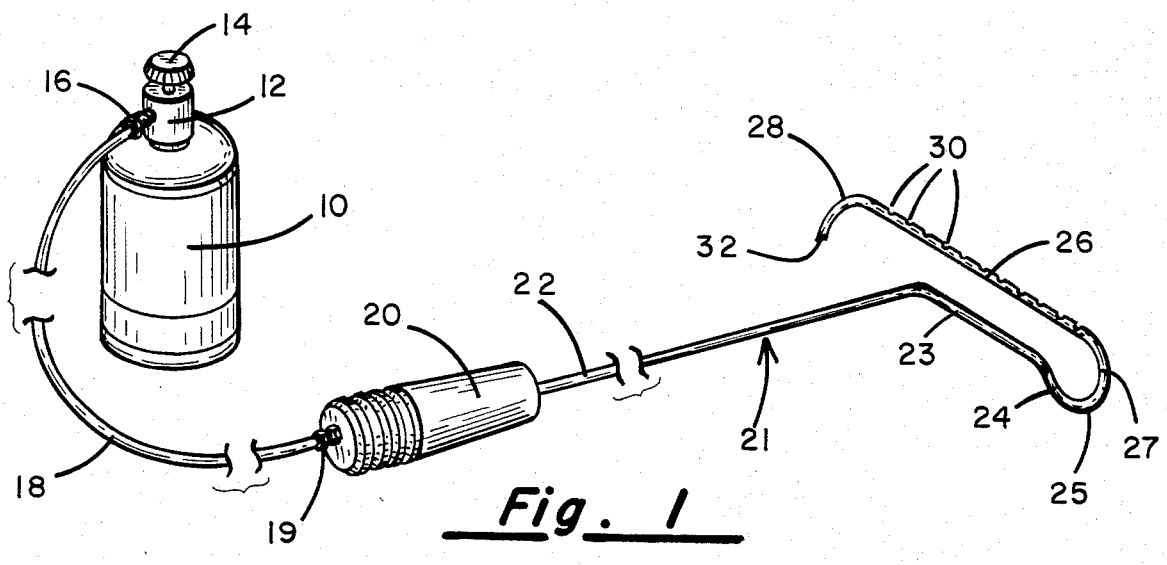
FIG. 1 is an isometric perspective view of the invention.
Figure 2:
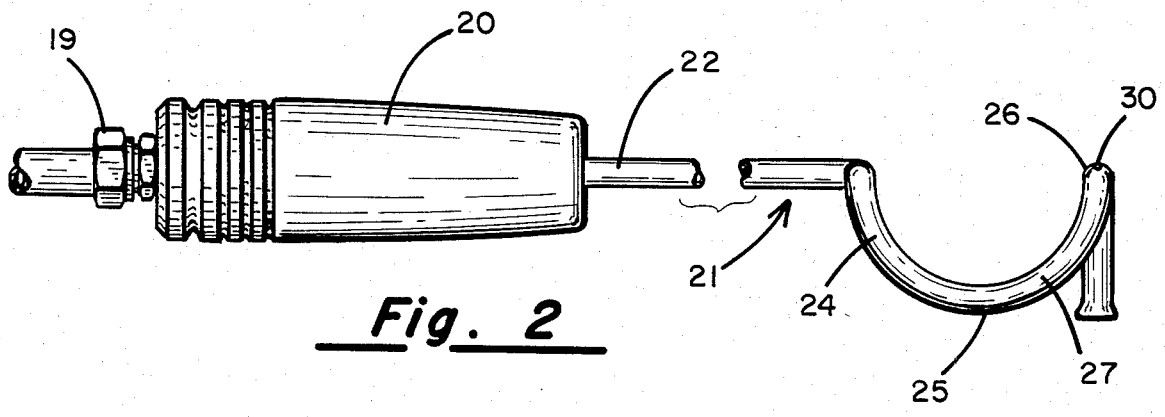
FIG. 2 is a side elevation view of the invention, with parts broken away.
Figure 3:
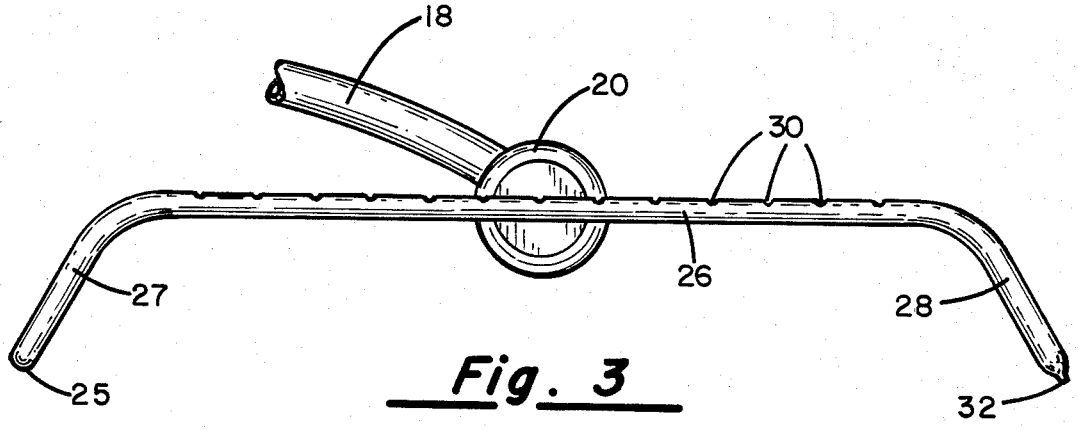
FIG. 3 is an end elevation view of the invention, with parts broken away.

Referring first to FIG. 1, the invention is shown in perspective view. A compressed gas container 10 holds a supply of combustible gas, such as propane or butane, under pressure. Container 10 may be any of a number of well-known commercially available gas containers, all of which have a threaded top opening, with an internal release valve that becomes released upon threadably fastening an adapter or release mechanism to the container 10. A gas valve 12 is threadably attached to the top of container 10 in a known manner. Gas valve 12 has a rotatable valve knob 14 which may be turned to selectively release more or less compressed gas from container 10. A fitting 16 is threadably attached to gas valve 12, and fitting 16 forms an end on hose 18. Hose 18 is suitably selected from commercially available hoses for containing and delivering pressurized combustible gas of the type herein described.

The other end of delivery hose 18 is sealably connected to hollow tube 21. A heat insulating handle 20, made from wood or the like, is fitted over the connection linkage 19 between hose 18 and tube 21. Tube 21 is made of shape-retaining material, preferably steel, but in any event is formed out of a type of material which is useful for conducting combustible gas and capable of holding its shape under the conditions of use (including heat) to which it is subjected.

Tube 21 is formed into an elongated portion 22, which preferably extends for a distance of from 12–24 inches. Elongated portion 22, at its distal end, is bent and merges into a lateral stretch 23 and then into a further curved portion 24 which has a lower curve 25 functioning as a foot for resting on the floor of a firebox. Then comes an upward curved portion 27 and then a transverse curve, which is a more or less right angle bend, to the burner portion 26. Burner portion 26 has an array or series of openings 30 therealong, suitably in a row and preferably facing away from foot 25. Holes 30 may be formed by drilling or other suitable means. They are of relatively small size or diameter, for example about 1/16th inch, and may extend at approximately ½–1 inch intervals over the elongated length of burner portion 26. The distal end of burner portion 26 is formed into a more or less right angle bend 28 which terminates in a sealed foot end 32. Sealed end 32 may be formed by suitably crimping the end of tube 21, it being important that a gas tight seal be formed thereby. Leg portion 28 and leg portion 27 are preferably shaped along similar curves. All of the curves and other portions of tube 21 referred to herein should relate together so as to provide a tripod support base comprising crimped end 32, curve 25, and handle 20, which together provide a support for maintaining burner portion 26 with its openings 30 directed upwardly, as preferred.

Thus has been described an extraordinarily simple portable apparatus for igniting a fire in a fireplace or the like. The apparatus has as an essential feature an elongated tubular means for conduiting gas released from the canister 10. The elongated tubular means consists essentially of a canister-connected flexible hose 18 and a shape-retaining tube 21 connected to the hose. The shape-retaining tube is characterized by being a single continuous lenth of tubular material. Sublengths of that continuous length are shaped to perform special functions. An elongated portion 22 may be characterized as the handle portion for it carries the heat insulating handle 20 on it. Its length serves as a spacing means to distance the burn portion 26 from the handle 20. The burn portion 26 is oriented normal to or substantially transversely to the elongated portion or section 22. The openings 30 for the escape of combustible gas preferably are located on the upper surface of the burn portion 26 but may take various other forms of location without departing from the essential features of the invention. The length of the burn portion or section 26 likewise may be adjusted without departing from essential principles of the invention. At each end of the burn portion are leg portions 27 and 28, both formed by contouring the single length of tubing; and these contours may take other forms than specifically illustrated. For example, the legs 27 and 28 may depend perpendicularly downward from the burn portion 26 or even curve somewhat toward each other underneath the burn portion 26. If desired, the intermediate section 23 between the elongated handle bearing section 22 and bend 24 may be omitted by extending the elongated handle bearing section 22 directly from the contour forming a leg portion 24.

Still other specific forms other than specifically illustrated may be adopted without departing from the spirit or essential characteristics of the invention. Thus the embodiment illustrated is to be considered as illustrative, the scope of the invention being indicated by the appended claims rather than by the foregoing description; and all changes which come within the meaning and range of equivalency for the claims as properly construed for validity are therefore intended to be embraced thereby.

That which is claimed is:

1. Portable apparatus for igniting a fire in a fireplace or the like, comprising a canister for compressed combustible gas, valve means for releasing gas from the canister, and elongated tubular means for conduiting gas released from the canister, the elongated tubular means consisting essentially of a canister-connected flexible hose and a hose-connected single length of shape-retaining tubing, the tubing being characterized by having sublengths of its continuous length so shaped as to provide an elongated portion equipped with a heat-insulating handle at the end thereof proximate the hose, a burn portion oriented substantially transversely to the elongated portion and having openings therein for escape of combustible gas, and a leg portion at each end of the burn portion for supporting the burn portion in spaced relationship above the floor of a firebox, the leg portions being formed by bends in the continuous length of the tubing and the distal end of the tubing being closed.

2. The portable apparatus of claim 1 wherein the distal end of the tubing forms the foot of a leg portion.

3. The portable apparatus of claim 1 wherein a leg portion of the tubing forms the conduit connection between the burn portion of the tubing and the elongated portion equipped with the heat insulating handle.

4. Portable apparatus for igniting a fire in a fireplace or the like, connectable to a canister of compressed combustible gas, comprising valve means for releasing gas from the canister, and elongated tubular means for conduiting gas released from the canister, the elongated tubular means consisting essentially of a flexible hose and a hose-connected single length of shape-retaining tubing, the single lenth of tubing being characterized by being contoured so as to form a first portion of elongated character equipped with a heat insulating handle at its end proximate to the hose connection, a second portion forming a leg means, a third portion forming a burner length which is oriented substantially transversely to the first portion and has a series of openings therein for escape of combustible gas therefrom, and a fourth portion forming a leg portion at the terminal end of the tubing, the distal end of the tubing most remote from its connection to the hose being closed to form a gas tight seal.

5. The portable apparatus of claim 4 wherein the tubing includes a further portion between the first portion and second portion, the further portion being spaced from the burner length and lying substantially parallel thereto.

6. The portable apparatus of claim 4 wherein the tubing is further characterized in that the second portion forming a leg means is so contoured as to have a substantially U-shape, and wherein the first portion and two leg portions form a stable supporting tripod for positioning the burn portion at an elevated position with respect to the floor of a fireplace.

7. Portable apparatus for igniting a fire in a fireplace or the like, the feature consisting essentially of a single length of shape-retaining tubing, the single length of tubing being characterized by being contoured so as to form a first portion of elongated character equipped with a heat insulating handle, a second portion forming a leg means, a third portion forming a burner length which is oriented substantially transversely to the first portion and has a series of openings therein for escape of combustible gas therefrom, and a fourth portion forming a leg portion at the terminal end of the tubing, the distal end of the tubing most remote from its connection to the hose being closed to form a gas tight seal.

* * * * *